United States Patent [19]

Fogel et al.

[11] Patent Number: 4,771,491

[45] Date of Patent: Sep. 20, 1988

[54] REINFORCED WALL SOFT SIDE WATERBED

[75] Inventors: Isaac Fogel, Potomac; Donald W. Keefer, Pasadena, both of Md.

[73] Assignee: Classic Corporation, Jessup, Md.

[21] Appl. No.: 70,125

[22] Filed: Jul. 6, 1987

Related U.S. Application Data

[63] Continuation of Ser. No. 906,610, Sep. 10, 1986, abandoned, which is a continuation of Ser. No. 775,015, Sep. 11, 1985, abandoned.

[51] Int. Cl.[4] ..... A47C 19/00; A47C 27/08

[52] U.S. Cl. ..... 5/400; 5/451

[58] Field of Search ..... 5/400, 401, 451, 452, 5/460, 474

[56] References Cited

U.S. PATENT DOCUMENTS

| | | | |
|---|---|---|---|
| 4,346,489 | 8/1982 | McMullan | 5/451 |
| 4,389,741 | 6/1983 | Larson | 5/451 X |
| 4,506,397 | 3/1985 | Fogel et al. | 5/460 X |

FOREIGN PATENT DOCUMENTS

WO8101792 7/1981 PCT Int'l Appl. ..... 5/451

OTHER PUBLICATIONS

"The Call to Dream", Watercloud, 3-1979, pp. 8, 9, & 13-15.

Water Magazine, 10/1984, p. 21, "Strobel: A Bedtime Success Story".

Rainbow Ultimate Waterbed Mattress brochure, Mar. 1983, Classic Flotation Sleep Systems.

*Primary Examiner*—Carl D. Friedman

*Assistant Examiner*—Richard E. Chilcot, Jr.

*Attorney, Agent, or Firm*—Finnegan, Henderson, Farabow, Garrett & Dunner

[57] ABSTRACT

A rail assembly for a reinforced wall soft side waterbed includes at least one cushion assembly, each cushion assembly includes an upper rail of resilient material, a lower rail, and an L-shaped reinforcing bar which extends past the lower surface of the lower rail. The rail assembly is assemblable to a deck assembly including a side wall such that the depending flange of the L-shaped reinforcing member interlocks with the side wall of the deck assembly.

23 Claims, 7 Drawing Sheets

REINFORCED WALL SOFT SIDE WATERBED

This application is a continuation, of application Ser. No. 06/906,610, filed Sept. 10, 1986, now abandoned, which is a continuation of Ser. No. 06/775,015, now abandoned, filed Sept. 11, 1985.

1. Field of the Invention

The present invention relates to a reinforced wall soft side waterbed assembly.

2. Description of the Related Art

Beds utilizing fluid-filled mattresses, commonly known as waterbeds, have become popular in recent years. Waterbeds have evolved from relatively simple arrangements consisting of waterfilled bladders supported and confined by bulky, hard, peripheral support frames to waterbed mattresses and foundation combinations having the same general size and appearance as a conventional innerspring mattress and foundation set. Such arrangements are desirable because they are pleasant in appearance and use, and also allow for the use of standard bed clothes such as mattress covers and fitted sheets.

The recent development of reinforced soft side waterbeds allow a user to comfortably sit and lie on all portions of the waterbed including the periphery. An example of such a reinforced wall soft side waterbed is described in U.S. Pat. No. 4,506,397 to Fogel et al. This earlier arrangement by Fogel et al. includes a deck assembly having a side wall support member of substantially rectangular cross section fixed to the upper surface of a base and an annular cushion having an L-shaped reinforcing member along a portion of its lower and outer surfaces which engages the upper and inner surfaces of the rectangular side wall support member. The annular cushion is assembled to be interlocked with the rectangular side wall support member so that bed clothes can be tucked between the lower surface of the annular cushion and the adjacent upper surface of the rectangular side wall support member. In addition, the upper annular cushion extends down past the lower rectangular side wall support member in a sloping arrangement. Although this earlier construction of Fogel et al. constitutes a significant improvement over its predecessor arrangements, the shape of the upper annular cushion member requires a costly and time consuming forming operation to achieve the desired result. Further, the one piece annular support cushion and accompanying one piece lower deck portion were found to be bulky to ship and transport.

It is an object of the present invention to provide a reinforced wall soft side waterbed having superior durability with modest cost.

It is another object of the present invention to provide a reinforced wall soft side waterbed which is able to the shipped compactly and easy to assemble.

It is a further object of the present invention to provide a reinforced wall soft side waterbed having an attractive appearance and a comfortable sleeping surface.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

SUMMARY OF THE INVENTION

To achieve the foregoing objects, and in accordance with the purposes of the invention as embodied and broadly described herein, there is provided a rail assembly for a reinforced wall soft side waterbed comprising at least one cushion assembly, each cushion assembly including an upper rail of resilient material having upper, lower, and inside surfaces; a lower rail having upper, lower, and inside surfaces and ends; a reinforcing bar including a first portion and a second portion, the first portion being secured to the lower surface of the upper rail and the upper surface of the lower rail; and the second portion extending from the first portion, overlying the inside surface of the lower rail and including a depending flange portion extending past the lower surface of the lower member. It is preferable that the upper rail and the lower rail constitute one integral rail, and the lower surface of the upper of the lower rail and the upper surface of the lower rail define a slot for receiving the first portion of the reinforcing bar prior to assembly to the reinforcing bar. It is further preferable that the rail assembly include a deck assembly having a side wall defining a frame; the side wall having upper, lower, and inside surfaces; the lower surface of the lower rail of the cushion assembly overlying the upper surface of the side wall; the depending flange portion of the reinforcing bar overlying the inner side surface of the side wall.

It is preferable that a first angle between the first portion and the second portion of the reinforcing bar is obtuse and substantially equal to a second angle between the upper surface of the lower rail and the inside surface of the lower rail. It is further preferable that the first and second angles are substantially equal to a third angle between the upper surface of the bottom rail and the inner surface of the bottom rail as well as a fourth angle between the upper surface of the top rail and the inner surface of the top rail.

It is further preferable that the rail assembly include four of the cushion assemblies, the four cushion assemblies each comprising a side of a four sided rectangular cushion frame, the side wall frame being a four-sided rectangular frame underlying the cushion frame.

BRIEF DESCRIPTION OF THE DRAWINGS

The accompanying drawings, which are incorporated in and constitute a part of the specification, illustrate a preferred embodiment of the invention and, together with a general description given above and the detailed description of the preferred embodiment given below, serve to explain the principles of the invention.

DESCRIPTION OF THE PREFERRED EMBODIMENT

Reference will now be made in detail to the present preferred embodiment of the invention as illustrated in the accompanying drawings.

In accordance with the present invention there is provided a rail assembly for a reinforced wall soft side waterbed comprising: at least one cushion assembly, each cushion assembly including an upper rail of resilient material having upper, lower, and inside surfaces; a lower rail having upper, lower, and inside surfaces and ends; a reinforcing bar including a first portion and a second portion, the first portion being secured to the lower surface of the upper rail and the upper surface of the lower rail; and the second portion extending from the first portion, overlaying the inside surface of the lower rail and including a depending flange portion extending past the lower surface of the lower member.

Figure 1:
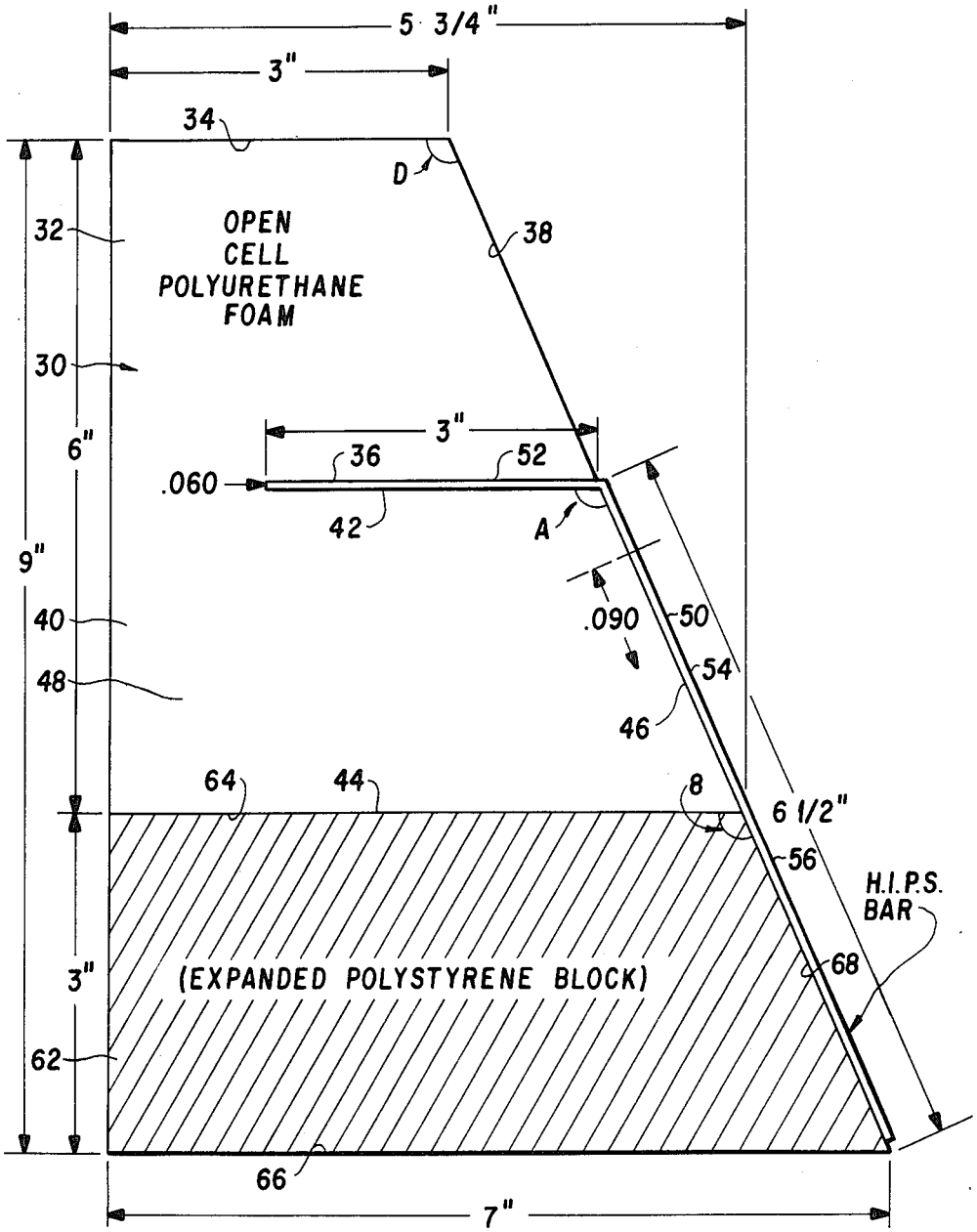
FIG. 1 is a side elevation view in cross section of a rail and side wall of a waterbed incorporating the teachings of the present invention.
Figure 2:
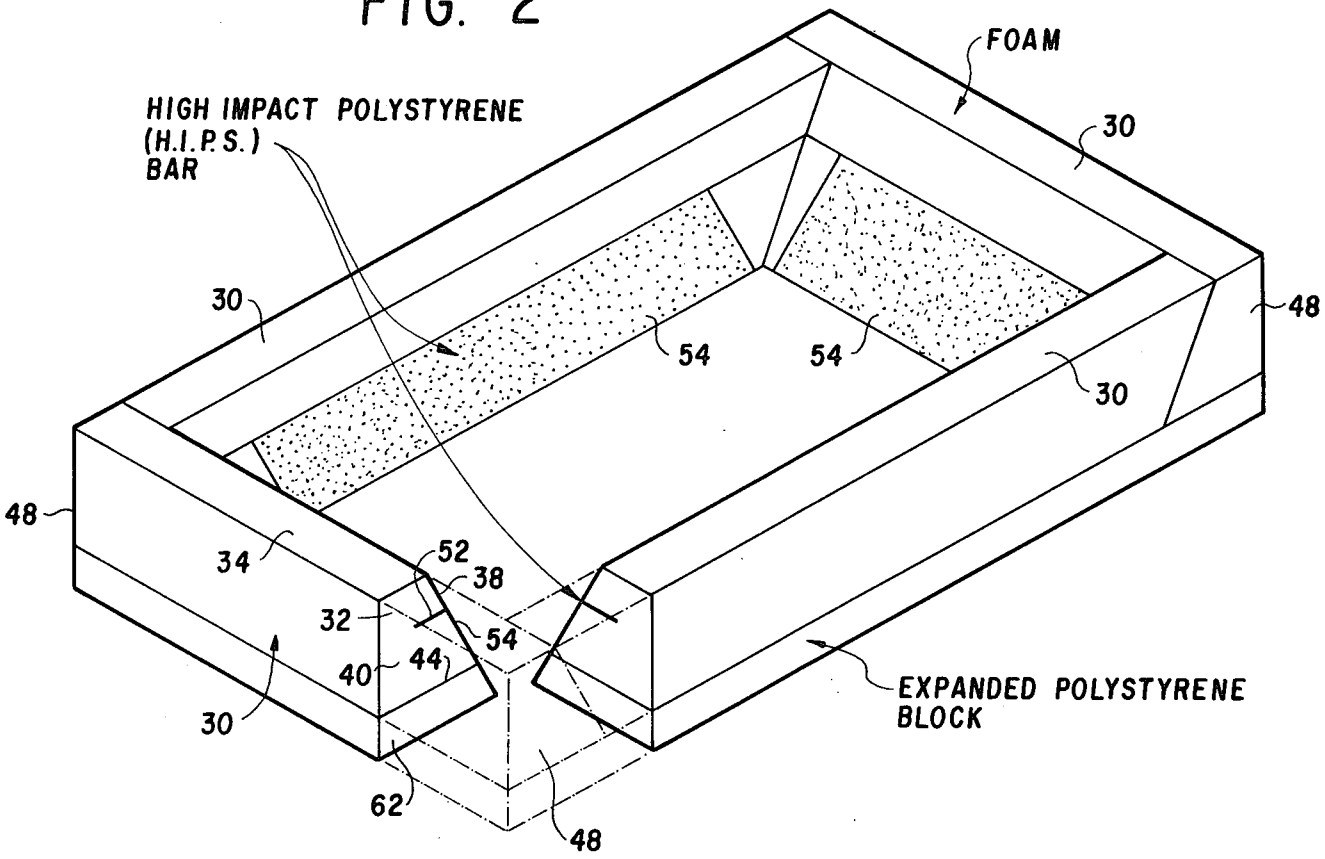
FIG. 2 is a perspective view of an assembled rail and side wall arrangement of a waterbed according to the teactings of the present invention.

As shown in FIGS. 1 and 2, a rail assembly for a reinforced soft side waterbed comprises at least one cushion assembly 30, each cushion assembly 30 including an upper rail 32 of resilient material such as open cell polyurethane foam having an upper surface 34, a lower surface 36 and an inside surface 38. The cushion assembly also includes a lower rail 40 having an upper surface 42, a lower surface 44, an inside surface 46 and ends 48.

Each cushion assembly also includes a reinforcing bar 50 made from high impact polystyrene material including a first portion 52 and a second portion 54. The first portion 52 is secured to the lower surface 36 of the upper rail 32 and the upper surface 42 of the lower rail 48. The second portion 54 of the reinforcing bar 50 extends from the first portion 52. Second portion 54 overlays the inside surface 46 of lower rail 48 and includes a depending flange portion 56 extending past the lower surface 44 of the lower rail 48.

Upper rail 32 and lower rail 40 preferably constitute one integral rail which is a single piece of flexible polyurethane foam such that the lower surface 36 of upper rail 32 and the upper surface 42 of lower rail 40 define a wall of a slot for receiving the first portion 52 of reinforcing bar 50 prior to assembly to the reinforcing bar 50. In such a preferred construction, lower rail 40 is composed of the same resilient material as upper rail 32.

The integral rail has an upper surface 34, a lower surface 44, and an inside surface 38 and 46. A longitudinal slot is formed along the inside surface of the rail, the slot including walls 36 and 42 extending inward from the inside surface 38 and 46 of the rail. One flange 52 of a reinforcing bar 50 having two flanges 52 and 54 is inserted into the slot and the reinforcing bar 50 is fastened in the slot so that the second flange 54 of the reinforcing bar extends past the lower surface 44 of the integral rail.

There are two preferred ways of accomplishing this method. The first way includes performing the forming steps prior to the inserting and fastening steps by forming the integral rail apart from the reinforcing bar, separating the wall 36 and 42 of the slot and applying adhesive to at least one of the slot walls and the first flange 52 of the reinforcing bar 50, and closing the walls 36 and 42 of the slot to contact and adhere to the first flange 52 of the reinforcing bar. The second way of accomplishing the method is to perform the forming, inserting, and fastening steps at one time by molding the integral rail around the first flange 52 of the reinforcing bar.

As shown in FIG. 2, it is preferable that both the first portion 52 and the second portion 54 extend along substantially the full length of upper rail 32 and lower rail 40. Such an arrangement gives great strength to the structure through a leaf spring type of action to contain a waterbed located between the rails.

Reinforcing bar 50 is preferably L-shaped in cross section having first and second flanges, wherein the first portion 52 is one flange of the L-shape and the second portion 54 is the second flange of the L-shape.

Figure 3:
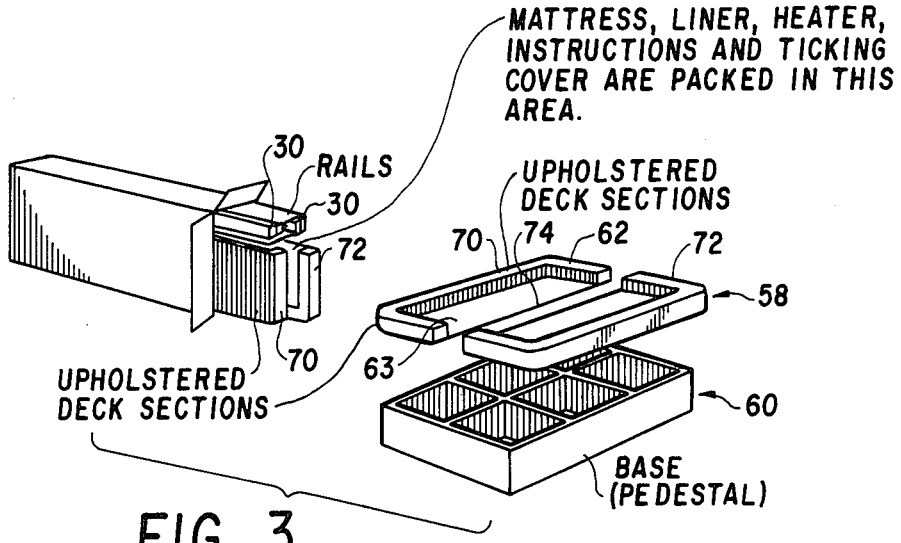
FIG. 3 is an exploded perspective view of a side wall, deck and pedestal before and after it is unpacked from a shipping carton.
Figure 4:
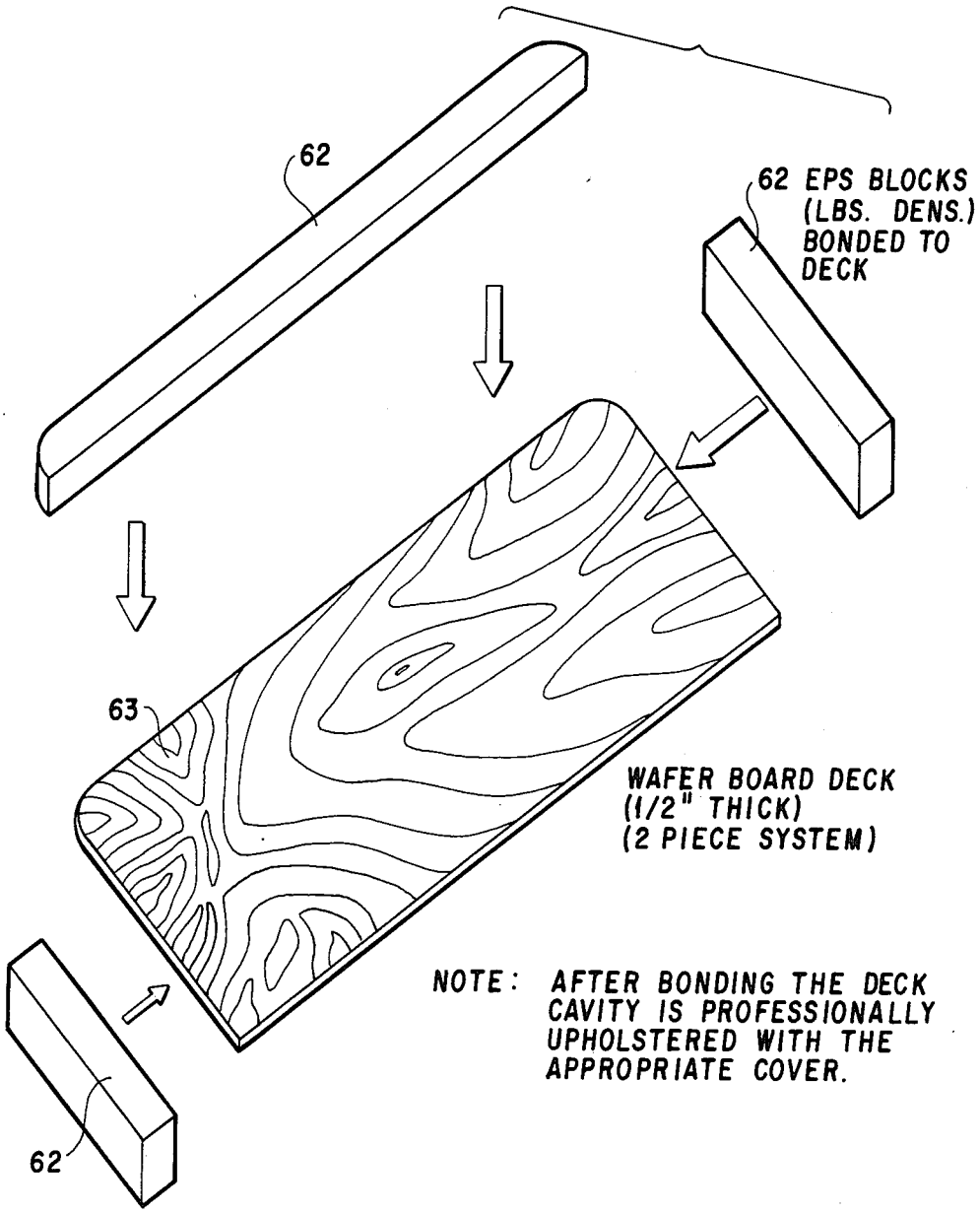
FIG. 4 is an exploded perspective view of one of the deck and side wall sections shown in FIG. 3 before being preassembled.

As shown in FIG. 3, there is further provided a deck assembly 58 which is placed on pedestal assembly 60. Deck assembly 58 includes a side wall 62 preferably made of an expanded polystyrene block which is mounted on a wafer board deck 63 as shown in FIG. 4. Wafer board deck 63 constitutes deck means attached to the lower surface 66 of side wall 62 for supporting a waterbed mattress within side wall 62. Side wall 62 is shown in FIGS. 1 and 2 with wafer board deck 63 removed for clarity.

As shown in FIG. 1, side wall 62 includes an upper surface 64, a lower surface 66, and an inside surface 68. The lower surface 44 of lower rail 40 of the cushion assembly 30 overlies the upper surface 64 of the side wall 62 so that the depending flange portion 56 of reinforcing bar 50 overlies the inside surface 68 of side wall 62. As shown in FIG. 2, such an arrangement allows cushion assembly 30 to be securely interlocked with side wall 62 through the use of flange portion 56. Even though the cushion assembly 30 and side wall 62 are interlocked to prevent relative lateral movement, cushion assembly 30 may be removed and replaced by lifting it vertically from side wall 62 as shown in FIG. 5.

As shown in FIG. 3, deck assembly 58 preferably includes at least two assemblable parts, 70 and 72, each part 70 and 72 including a preassembled portion of the deck 63 and the side wall 62, parts 70 and 72 defining a line 74 where the parts 70 and 72 abut each other upon assembly to each other. As shown in FIG. 5, line 74, shown as a broken line, is positioned between the ends 48 of lower rail 40, for purposes of strength and stability, so as not to be aligned with the ends 48 of the lower rail. For the same reason, the flange portion 56 has two ends such that the line of assembly 74 is positioned between the ends of flange portion 56 so as not to be aligned with the ends of flange portion 56.

Figure 5:
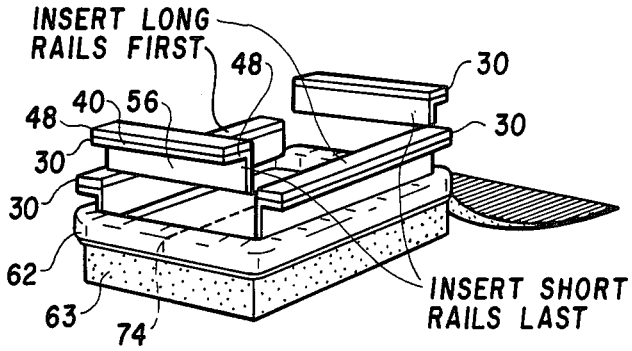
FIG. 5 is an exploded perspective view of the rail and side wall assembly step.

As shown in FIGS. 2 and 5, the rail assembly preferably includes four cushion assemblies 30 so that the four cushion assemblies each comprise a side of and are assemblable to form a four-sided rectangular cushion frame. In addition, the side wall frame 62 is a four-sided rectangular frame underlying the cushion frame 30. Such an arrangement allows for easy shipping, storage, assembly, and disassembly. Although cushion assembly 30 is preferably made in four pieces, it can be made in more or less pieces including a single annular unit.

According to the embodiment shown in FIG. 1, it is preferable that a first angle A between first portion 52 and second portion 54 of reinforcing bar 50 is obtuse and substantially equal to a second angle A between the upper surface 42 of lower rail 48 and inside surface 46 of lower rail 48. It is further preferable that first and second angles A are substantially equal to a third angle B between the upper surface 64 of the side wall 62 and the inner surface 68 of side wall 62. It is additionally preferable that the first, second, and third angles are substantially equal to a fourth angle D between the upper surface 34 of top rail 32 and the inside surface 38 of the top rail 32. It is preferable that the first and second angles A are approximately 114 degrees. By using a frame with an obtuse inner surface, the waterbed mattress is supported more at the bottom where there are higher hydrostatic pressures. In addition, this arrangement prevents the side wall from bending laterally when sat upon by a user.

FIG. 5 shows an alternative embodiment of the invention having right angles A-D.

The present invention provides a method for assemblying a bed frame from partially preassembled component units including the following steps, each illustrated sequentially in a separate figure. As shown in FIG. 3, two preassembled deck sections 70 and 72 are placed on top of pedestal 60 so that they contact each other along line 74.

Figure 6:
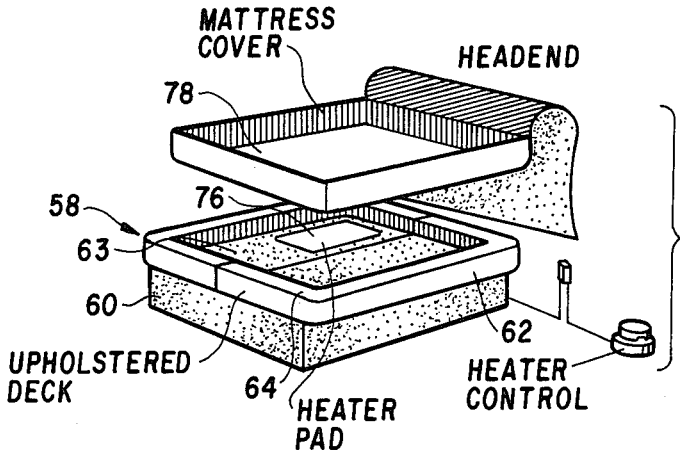
FIG. 6 is an exploded perspective view of a mattress cover and the deck assembly shown in FIG. 3.

As shown in FIG. 6, heater pad 76 is placed on upholstered deck 63 and mattress cover 78 is placed into deck assembly 58 so that it extends over and beyond the top surface 64 of side wall 62.

Figure 7:
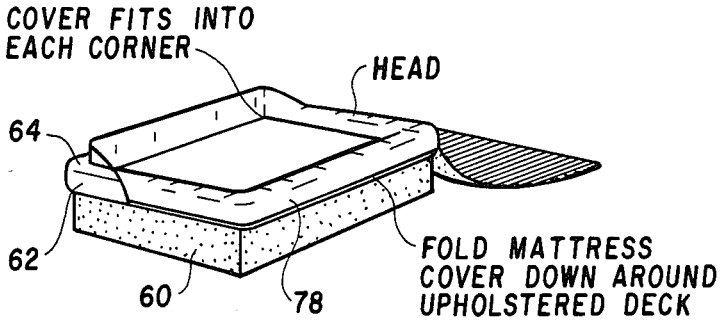
FIG. 7 is a partially assembled perspective view of the arrangement shown in FIG. 6.

As shown in FIG. 7, mattress cover 78 is wrapped around side wall 62 in preparation for the next step.

As shown in FIG. 5, resilient rail assemblies 30 are then inserted so that they overlie the upper surface of side wall 62 and the flange portion 56 overlies the inside of side wall 62.

Figure 8:
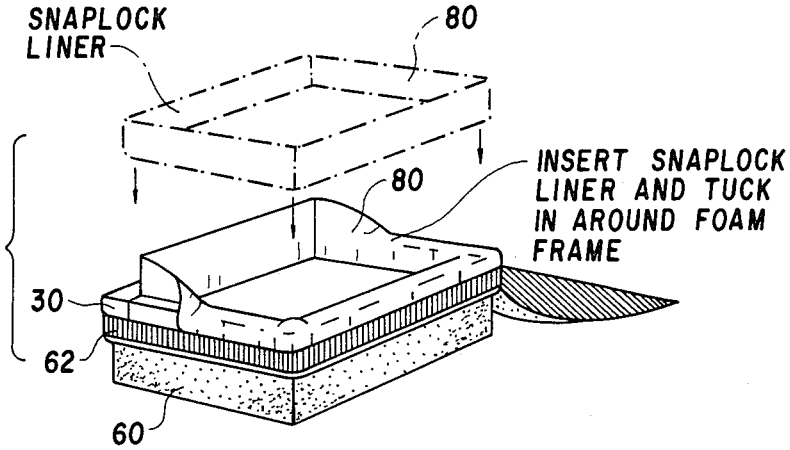
FIG. 8 is an exploded and partially assembled perspective view of a liner and the assembled arrangement of FIG. 5.

As shown in FIG. 8, a snap lock liner 80 is placed inside the resilient rail assembly 30 and side wall 62 and tucked around the outside of resilient rail assemblies 30.

Figure 9:
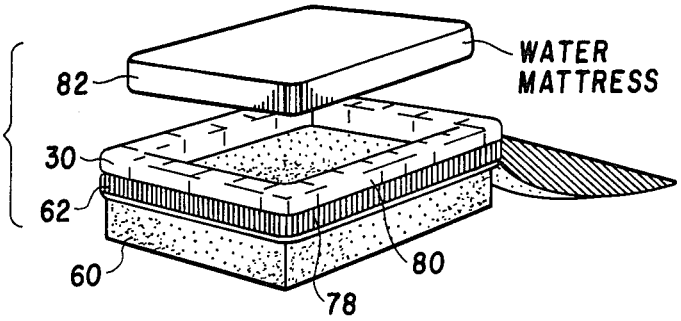
FIG. 9 is an exploded perspective view of a water mattress and the arrangement shown in FIG. 8.

As shown in FIG. 9, an empty water mattress 82 is placed inside the cavity formed by resilient rail 30 and side wall 62.

Figure 10:
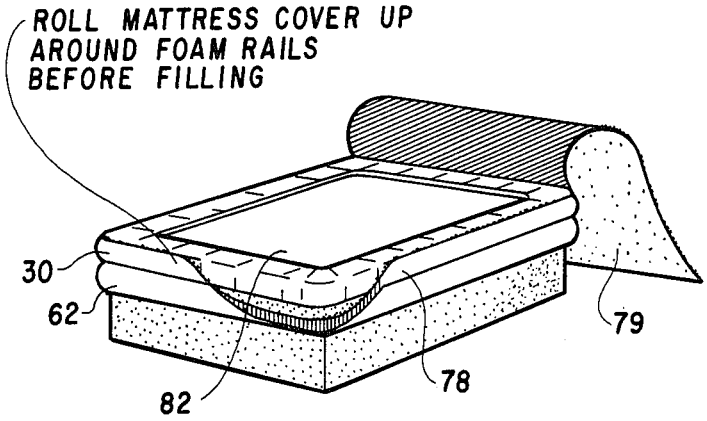
FIG. 10 is a partially assembled perspective view of the arrangement shown in FIG. 9 with the mattress cover partially rolled around the rails before filling the waterbed mattress.

As shown in FIG. 10, mattress cover 78 is rolled up on resilient rail 30 and the top portion 79 of mattress cover 78 is placed over the top surface of water bed mattress 82 and rails 30. Conventional bed clothes can then be used to make up the bed and can be tucked into the interface between resilient rail 30 and side wall 62.

The use of this arrangement of elements in a reinforced wall soft side waterbed allows reinforcement of the walls to prevent bowing and, consequently, enhances the durability of the system. It also creates a self locking positioning of the wall structure eliminating any possibility of misalignment the structure can be assembled without the use of tools or hardware. In addition, it furnishes a firm, comfortable seating area in the walls by providing a leaf spring type of action which further enhances the durability of the wall structure. It is clear that these principles may be easily adapted and employed in wall structures of different configurations, thicknesses, and depths and the invention is therefore not limited to the shape illustrated.

Additional advantages and modifications will readily occur to those skilled in the art. The invention and its broader aspects is, therefore, not limited to the specific details, representative apparatus and illustrative examples shown and described. Accordingly, departures may be made from such details without departing from the spirit or scope of applicants' general inventive concept.

What is claimed is:

1. A rail assembly for a reinforced wall softside waterbed comprising:

at least one cushion assembly, each cushion assembly including an upper rail of resilient material having upper, lower and inside surfaces;

a lower rail having upper, lower and inside surfaces and ends;

a deck assembly including a sidewall defining a frame, the sidewall having upper, lower and inside surfaces, the lower surface of the lower rail of the cushion assembly overlying the upper surface of the sidewall;

a reinforcing bar including a first portion and a second portion, the first portion being secured to the lower surface of the upper rail and the upper surface of the lower rail; and the second portion extending from the first portion, overlying and contacting the inside surface of the lower rail and including a depending flange portion extending past the lower surface of the lower rail and overlying and contacting the inside surface of the sidewall.

2. A rail assembly according to claim 1 wherein the upper rail and the lower rail constitute one integral rail, and the lower surface of the upper rail and the upper surface of the lower rail define the walls of a slot for receiving the first portion of the reinforcing bar prior to assembly to the reinforcing bar.

3. A rail assembly according to claim 1, wherein the lower rail is composed of a resilient material.

4. A rail assembly according to claim 1, wherein the first portion extends along substantially the full length of the upper and lower rails.

5. A rail assembly according to claim 1, wherein the second portion extends along substantially the full length of the upper and lower rails.

6. A rail assembly according to claim 1, wherein the reinforcing bar is L-shaped in cross section having first and second flanges, wherein the first portion is one flange of the L-shape and the second portion is second flange of the L-shape.

7. A rail assembly according to claim 1, wherein the deck assembly includes deck means attached to the lower surface of the sidewall for supporting a mattress within said sidewall.

8. A rail assembly according to claim 7, wherein the deck assembly includes at least two assemblable parts, each said part including a preassembled portion of the deck means and the sidewall, said parts defining a line where said parts abut each other upon assembly.

9. A rail assembly according to claim 8, wherein the line of assembly is positioned between the ends of the lower rail so as not to be aligned with the ends of the lower rail.

10. A rail assembly according to claim 1, wherein the flange portion has two ends and wherein the line of assembly is positioned between the ends of the flange portion so as not to be aligned with the ends of the flange portion.

11. A rail assembly according to claim 1, including four of the cushion assemblies, the four cushion assemblies each comprising a side of and assemblable to form a four sided rectangular cushion frame, the side wall frame being a four sided rectangular frame underlying said cushion frame.

12. A rail assembly according to claim 1 wherein a first angle between the first portion and the second portion of the reinforcing bar is obtuse and substantially equal to a second angle between the upper surface of the lower rail and the inside surface of lower rail.

13. A rail assembly according to claim 12 wherein the first and second angles are substantially equal to a third angle between the upper surface of the sidewall and the inner surface of the sidewall.

14. A rail assembly according to claim 13 wherein the first, second and third angles are substantially equal to a fourth angle between the upper surface of the top rail and the inside surface of the top rail.

15. A rail assembly according to claim 12 wherein the first and second angles are approximately 114°.

16. A rail assembly comprising at least one cushion assembly, each cushion assembly being a preassembled unit including:

an upper rail, each upper rail being composed of a resilient material and having upper and lower surfaces;

a lower rail, said lower rail having upper, lower and inside surfaces and ends;

an L-shaped reinforcing bar, said reinforcing bar being attached to said upper and lower rails and having first and second portions;

said first portion extending along and attached to substantially the full length of the lower surface of the upper rail;

said second portion extending from the first portion, overlying and contacting the inside surface of the lower rail and having a flange portion extending past the lower surface of the lower member, said second portion extending along substantially the full length of the upper and lower rails.

17. A method of assembling a rail and deck assembly for a bed comprising:

forming a deck assembly having a sidewall with top and inside surfaces which form a frame, forming an integral rail from resilient material, the integral rail having upper, lower and inside surfaces, such that the lower surface of the integral rail overlies the top surface of the sidewall of the deck assembly, forming a longitudinal slot along the inside surface of the rail and having walls extending inward from the inside surface of the rail, inserting one flange of a reinforcing bar having two flanges into the slot, and fastening the reinforcing bar in the slot so that the second flange of the reinforcing bar overlies and contacts the inside surface of the integral rail and extends past the lower surface of the integral rail while overlying and contacting the inside surface of the sidewall.

18. A method according to claim 17 wherein the forming steps are performed prior to the inserting and fastening steps and wherein the inserting and fastening steps include separating the walls of the slot and applying adhesive to at least one of the slot walls and the first of the reinforcing bar, and closing the walls of the slot to contact and adhere to the first flange of the reinforcing bar.

19. A method according to claim 17 wherein the forming, inserting and fastening steps include molding the integral rail around the first flange of the reinforcing bar.

20. A method for assembling a bed frame comprising:

providing a deck assembly having a sidewall with top and inside surfaces which form a frame;

providing resilient rail assemblies, each assembly having upper, lower and outer surfaces, and an inside surface overlayed by a reinforcing bar having a depending flange portion extending past the lower surface of the rail assembly; and overlying the upper surface of the side wall with the resilient rail assembly and overlying and contacting the inside surface of the side wall with the flange portion to prevent outward movement of the rail assemblies relative to the deck assembly.

21. The method of claim 20 including placing a mattress cover into the deck assembly before the overlying step so that it extends over and beyond the top surface of the sidewall.

22. The method of claim 21, including covering the outer surface of the resilient rail assemblies with the mattress cover after the overlying step.

23. The method of claim 22, including putting a liner inside the frame and over the top and outer surfaces of the resilient rail assemblies after the placing step and before the covering step.

* * * * *